US007222376B1

(12) United States Patent
Gunning

(10) Patent No.: US 7,222,376 B1
(45) Date of Patent: May 29, 2007

(54) ELLIPTICAL SHOWER ROD AND BRACKET APPARATUS

(75) Inventor: Robert A. Gunning, Portsmouth, NH (US)

(73) Assignee: Harney Hardware, Inc., Thonotosassa, FL (US)

( * ) Notice: Subject to any disclaimer, the term of this patent is extended or adjusted under 35 U.S.C. 154(b) by 0 days.

(21) Appl. No.: 11/461,886

(22) Filed: Aug. 2, 2006

(51) Int. Cl.
*A47K 3/38* (2006.01)

(52) U.S. Cl. ..... 4/610; 248/262

(58) Field of Classification Search ..... 4/557, 4/558, 608, 610; 248/262, 264; 211/105.1, 211/105.2

See application file for complete search history.

(56) References Cited

U.S. PATENT DOCUMENTS 4,767,013 A * 8/1988 Bertelli ..... 211/96
D397,928 S 9/1998 Wise
D426,142 S 6/2000 Moore
6,138,970 A 10/2000 Sohrt et al.
6,216,287 B1 4/2001 Wise
6,263,523 B1 7/2001 Moore
6,694,543 B2 * 2/2004 Moore ..... 4/610
2005/0268394 A1 12/2005 Monk et al.

* cited by examiner

*Primary Examiner*—Huyen Le
(74) *Attorney, Agent, or Firm*—Phillip E. Decker; Mesmer & Deleault, PLLC

(57) ABSTRACT

An adjustable bowed shower rod and bracket that is simple, strong, and attractive having an elliptical cross section; a semi-capsular wall bracket with a semi-cylindrical middle section and a cutout in the middle section having a height between one quarter and one half the height of the bracket; and a swivel having a cylindrical vertical member longer than the height of the bracket cutout of a diameter selected to fit completely within the bracket middle section and an elliptical horizontal member secured perpendicularly to the vertical member on a first end and sized to receive the rod in an overlapping fit on a second end. The swivel vertical member can be assembled into the bracket with the swivel horizontal member protruding through the bracket cutout, and the elliptical rod can come into communication with the swivel horizontal member, thereby assembling the shower rod and bracket apparatus. The brackets do not require any pivot pin or backing plate.

20 Claims, 3 Drawing Sheets

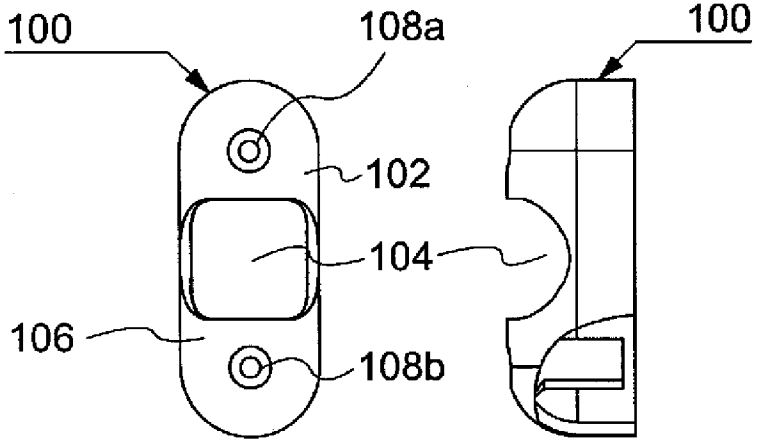
Fig. 1
Fig. 2
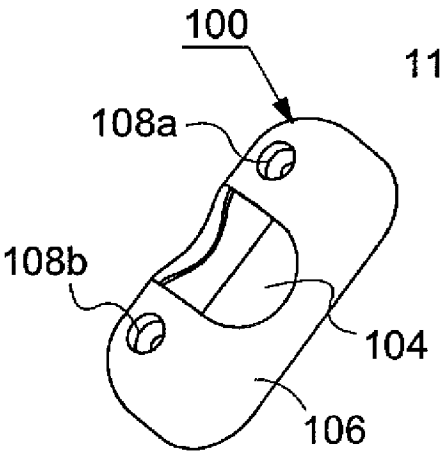
Fig. 3
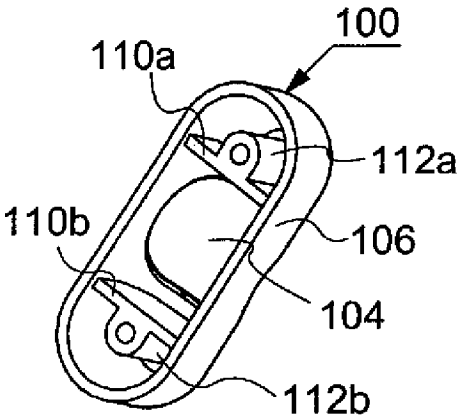
Fig. 4

ELLIPTICAL SHOWER ROD AND BRACKET APPARATUS

BACKGROUND

1. Field of the Invention

The invention is in the field of swiveling brackets and rods for shower curtains.

2. Description of the Related Art

To be competitive, bathroom fixtures must have a combination of strength, utility, and beauty. In the field of shower rod assemblies, providing a curved or bowed shower rod and brackets appropriate to support the rod enhances utility. The bowed rod holds a shower curtain away from the bather, effectively increasing the space in the shower. One example of this is shown in U.S. Pat. Nos. D397,928 and 6,216,287 by Wise, which are not admitted to being prior art by their mention in this background section. The Wise patents have a bowed shower rod, but the brackets cannot swivel and require backing plates. The bow radius and bracket angles must be cut precisely for the specific application, or the apparatus will not assemble correctly.

Another example is disclosed in U.S. Pat. App. Pub. No. 2005/0268394 A1 to Monk et al., which is not admitted to being prior art by its mention in this background section. Monk discloses a multi-part rod with multiple bends. The bracket swivels, but requires a two-piece pivot pin on each end. Although the rod and bracket assembly is adjustable for different sizes of showers and shower/tubs, the assembly is complex and therefore expensive.

Yet another example is shown in U.S. Pat. Nos. D426,142 and 6,263,523 by Moore, which are not admitted to being prior art by their mention in this background section. The Moore patents have rotatable bracket assemblies in the shape of a truncated oblate spheroid. They require the use of a pivot pin in the bracket to enable rotation. The '523 patent also requires that the brackets have end plates to attach them to walls and that the rod has straight portions near the ends and a curved portion near the center. This design is also complex, and therefore expensive. Over time, complex apparatuses are more liable to failure than simple ones. Simple apparatuses are usually stronger and have better aesthetic qualities.

What is needed, therefore, is an adjustable bowed shower rod and bracket assembly that is simple, strong, and attractive.

SUMMARY

The invention is a kit and apparatus that satisfies these needs. An adjustable bowed shower rod and bracket that is simple, strong, and attractive has a rod with a substantially elliptical cross section; a substantially semi-capsular wall bracket comprising a substantially semi-cylindrical middle section and a cutout in the middle section having a height between one quarter and one half the height of the bracket; and a swivel comprising a substantially cylindrical vertical member longer than the height of the bracket cutout of a diameter selected to fit completely within the bracket middle section and a substantially elliptical horizontal member secured perpendicularly to the vertical member on a first end and sized to receive the rod in an overlapping fit on a second end, whereby the swivel vertical member can be assembled into the bracket with the swivel horizontal member protruding through the bracket cutout, and the elliptical rod can come into communication with the swivel horizontal member, thereby assembling the shower rod and bracket apparatus. The brackets require no back plates. These and other benefits, features, and advantages will be made clearer in the accompanying description, claims, and drawings.

DRAWINGS

FIG. 1 is a plan view of a bracket component according to the present invention.

FIG. 2 is a side elevation of the bracket of FIG. 1.

FIG. 3 is a perspective view of the bracket of FIGS. 1 and 2.

FIG. 4 is a reverse perspective view of the bracket view of FIG. 3.

DESCRIPTION

Figure 6:
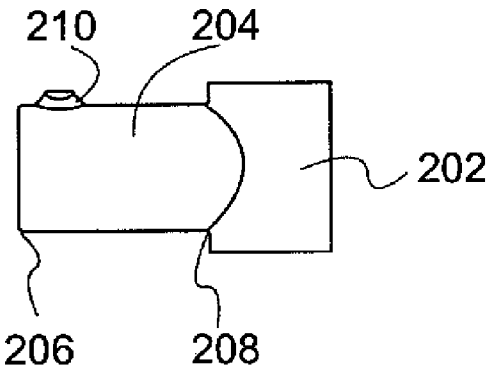
FIG. 6 is a side elevation of the swivel of FIG. 5.

The invention is a shower rod and bracket apparatus comprising a bowed rod having a substantially elliptical cross section; a substantially semi-capsular wall bracket comprising a substantially semi-cylindrical middle section and a cutout in the middle section having a height between one quarter and one half the height of the bracket; and a swivel comprising a substantially cylindrical vertical member longer than the height of the bracket cutout of a diameter selected to fit completely within the bracket middle section and a substantially elliptical horizontal member secured perpendicularly to the vertical member on a first end and sized to receive the rod in an overlapping fit on a second end, whereby the swivel vertical member can be assembled into the bracket with the swivel horizontal member protruding through the bracket cutout, and the elliptical rod can come into communication with the swivel horizontal member, thereby assembling the shower rod and bracket apparatus.

Turning to FIG. 1 and FIG. 2, the bracket 100 is approximately the shape of a half medicine capsule, which is referred to as "semi-capsular" in this specification. The external body of the bracket 100 is the semi-capsular shell 106. The middle part 102 of the shell 106 forms substantially a half a cylinder, and has an opening 104 substantially in the middle. The height of the opening 104 is between one quarter and one half the height of the bracket 100, but is preferably about one third the height of the bracket 100. FIG. 1 details the plan view of the bracket 100, whereas FIG. 2 details a side elevation of the bracket 100. FIG. 2 also shows a cut away view of some internal features. The bracket 100 can be made of zinc, brass, stainless steel, aluminum, or plastic.

The bracket 100 has at least one but preferably two holes 108*a*, 108*b* outside the cutout 104 that are adapted to receive mounting screws or equivalent mounting means for mounting the bracket 100 on a shower or shower/tub wall. No mounting brackets are required.

FIG. 3 is a perspective view of the bracket shown in FIGS. 1 and 2. FIG. 4 shows the reverse perspective view of FIG. 3, and provides details of a pair of bulkheads 110*a*, 110*b* secured parallel to each other within the bracket 100 and perpendicular to the bracket's longitudinal axis. The bulkheads 110*a*, 110*b* are spaced at a distance that is greater than the length the swivel vertical member, discussed below. The bulkheads have several functions. For example, they increase the strength of the bracket, they help guide the swivel member for rotating within the bracket, and can also work as a thrust bearing surface to support the weight of the shower rod when assembled.

Optional features adjacent to the bulkheads 110*a*, 110*b* are mounting hole guides 112*a*, 112*b*. The mounting hole guides 112*a*, 112*b* can be formed as an integral part of the bulkheads as shown or not. The mounting hole guides 112*a*, 112*b* are in locations that correspond with mounting holes 108*a*, 108*b*. In the preferred embodiment, the bracket 100 has an outside width of about 35 mm and outside height of about 89 mm.

Figure 5:
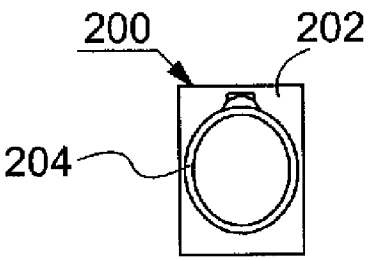
FIG. 5 is a plan view of a swivel component according to the present invention.
Figure 7:
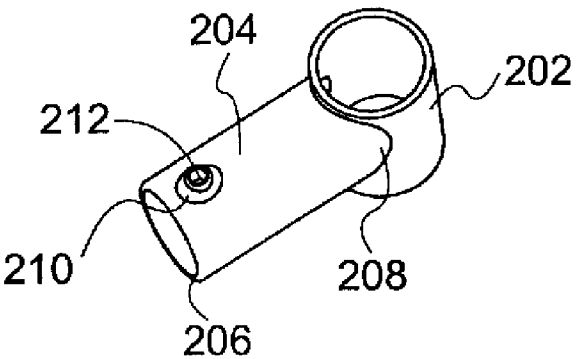
FIG. 7 is a perspective view of the swivel of FIGS. 5 and 6.

FIGS. 5, 6, and 7 show details of the swivel 200 from a plan view, side elevation, and perspective view respectively. The swivel 200 has a substantially cylindrical vertical member 202 that is longer than the height of the bracket cutout 104 so that the bracket 100 will retain the swivel 200 when assembled. The outside diameter of the vertical member 202 should be smaller than the inside diameter of the bracket shell 106 so that it operates properly when assembled. In the preferred embodiment, the vertical member is about 29 mm in outside diameter and about 40 mm in height. No pivot pin or screw is required to keep the swivel in place, which reduces the number of parts required.

A substantially elliptical horizontal member 204 is either secured to, or formed as a part of, the vertical member 202 at a horizontal member first end 208. The horizontal member 204 and vertical member 202 are in a substantially perpendicular relationship. In the preferred embodiment, a boss 210 is present near the horizontal member second end 206 opposite the first end 208. The boss 210 gives support for a hole 212 having an internal thread. This enables the operator to secure a shower rod with a screw, as described in more detail below.

The ellipse of the horizontal member 204 is preferably has its major axis aligned with the vertical member 202. The preferred dimensions are about 26.25 mm on the inside major axis and about 22.75 mm on the inside minor axis. The swivel 200 can be made of zinc, brass, stainless steel, aluminum, or plastic.

Figure 8:
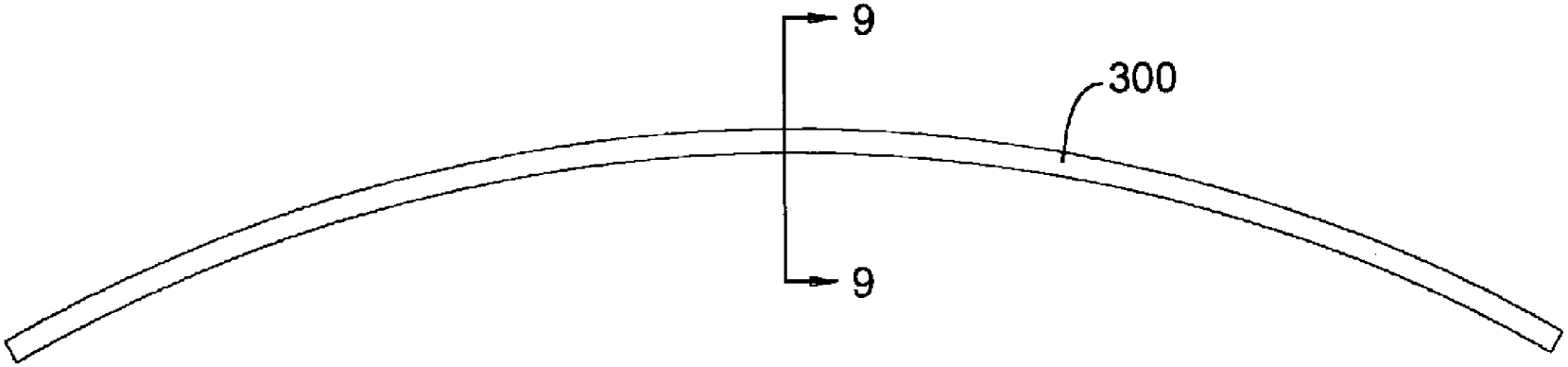
FIG. 8 is a plan view of a rod component according to the present invention.
Figure 9:
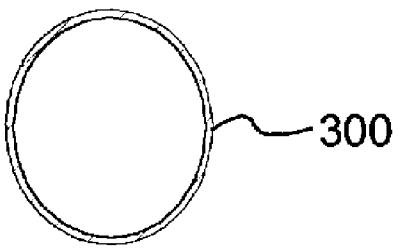
FIG. 9 is a cross section view of the rod shown in FIG. 8.

FIG. 8 is a plan view of the bowed shower rod 300. FIG. 9 is a cross section view of the rod 300 showing the elliptical nature of the section. The rod 300 is preferably made of stainless steel, particularly type 304 or 304L. The rod should be bowed to a radius of about 203 cm, measured at the rod's neutral axis. In the preferred embodiment, the ellipse should be about 26 mm on the outside major axis and about 22.5 mm on the outside minor axis.

In operation, the bracket 100, swivel 200, and rod 300 can be provided as an assembled apparatus, as separate components, or as a kit for on-site installation. The user would insert the horizontal member 204 of the swivel 200 through the opening 104 in the bracket 100. The user would do this for a bracket 100 on each end of the rod 300. The opening 104 is shaped and sized to give sufficient clearance for the horizontal member 204 to swing back and forth. Particularly, the opening 104 should have rounded sides to conform to the ellipse of the swivel horizontal member 204, and a generally straight top and bottom. This facilitates assembly to the rod 300. The bracket 100 and swivel 200 assembly is then secured to suitable walls in a shower/bath enclosure using screws or other fastening means in the mounting holes 108*a*, 108*b*.

The rod 300 and the swivel horizontal member 204 are sized to have an overlapping sliding fit with the rod inside the swivel member. The rod 300 can be secured to the bracket and swivel assembly by using a threaded mounting screw in the mounting screw hole 212. Because the rod 300 is bowed and the brackets 100 have swivels 200, the components can be fit together even if the rod is not cut to the perfect size for the particular installation. The rod can be flexed, which causes the swivels 200 to rotate, and the ends of the rod and slide in and out. When the desired position is reached, the rod 300 is secured in position with screws. The bracket 100 is a clean and attractive semi-capsular shape that also increases its strength. The swivel 200 rotates without the need for a pivot pin of any kind. It is simple because the rod has only one piece and the bracket does not require pivot pins to operate.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A shower rod and bracket apparatus comprising:
- a bowed rod having a substantially elliptical cross section;
- a substantially semi-capsular wall bracket comprising:
  - a substantially semi-cylindrical middle section; and
  - a cutout in the middle section having a height between one quarter and one half the height of the bracket; and
- a swivel comprising:
  - a substantially cylindrical vertical member longer than the height of the bracket cutout of a diameter selected to fit completely within the bracket middle section; and
  - a substantially elliptical horizontal member secured perpendicularly to the vertical member on a first end and sized to receive the rod in an overlapping fit on a second end,
- whereby the swivel vertical member can be assembled into the bracket with the swivel horizontal member protruding through the bracket cutout, and the elliptical rod can come into communication with the swivel horizontal member, thereby assembling the shower rod and bracket apparatus.

2. The apparatus of claim 1, the swivel horizontal member comprising:
- a boss on its outside surface; and
- a hole with an internal thread running through the boss and the horizontal member perpendicular to the longitudinal axis of the horizontal member, whereby a screw can be used in the threaded hole to secure the rod in an overlapping fit with the swivel horizontal member.

3. The apparatus of claim 1, wherein the bow of the rod has a radius of about 203 cm.

4. The apparatus of claim 1, wherein the rod elliptical cross section measures about 26 mm on the outside major axis and about 22.5 mm on the outside minor axis.

5. The apparatus of claim 1, wherein the rod is made of 304 or 304L stainless steel tubing.

6. The apparatus of claim 1, the bracket further comprising a pair of bulkheads secured parallel to each other within the bracket and perpendicular to the longitudinal axis of the bracket spaced at a distance greater than the length of the swivel vertical member, thereby strengthening the bracket, guiding the swivel, and supporting the swivel and rod when assembled.

7. The apparatus of claim 1, the bracket further comprising a hole outside the cutout adapted to receive a mounting screw.

8. The apparatus of claim 1, wherein the bracket has about a 35 mm outside width.

9. The apparatus of claim 1, wherein the bracket has about a 89 mm outside height.

10. The apparatus of claim 1, wherein the bracket and swivel are made of one selected from the group consisting of zinc, brass, stainless steel, aluminum, and plastic.

11. The apparatus of claim 1, wherein the swivel vertical member has about a 29 mm outside diameter.

12. The apparatus of claim 1, wherein the swivel vertical member has about a 40 mm height.

13. The apparatus of claim 1, wherein the swivel horizontal member measures about 26.25 mm on the inside major axis and about 22.75 mm on the inside minor axis.

14. A kit for making a shower rod and bracket assembly comprising:

a bowed rod having a substantially elliptical cross section;

a substantially semi-capsular wall bracket comprising:

a substantially semi-cylindrical middle section; and a cutout in the middle section having a height between one quarter and one half the height of the bracket; and a swivel comprising:

a substantially cylindrical vertical member longer than the height of the bracket cutout of a diameter selected to fit completely within the bracket middle section; and a substantially elliptical horizontal member secured perpendicularly to the vertical member on a first end and sized to receive the rod in an overlapping fit on a second end, whereby the swivel vertical member can be assembled into the bracket with the swivel horizontal member protruding through the bracket cutout, and the elliptical rod can come into communication with the swivel horizontal member, thereby assembling the shower rod and bracket assembly.

15. The kit of claim 14, the swivel horizontal member comprising:

a boss on its outside surface; and a hole with an internal thread through the boss and the horizontal member perpendicular to the longitudinal axis of the horizontal member, whereby a screw can be used in the threaded hole to secure the rod in an overlapping fit with the swivel horizontal member.

16. The kit of claim 14, wherein the bow of the rod has a radius of about 203 cm and the rod elliptical cross section measures about 26 mm on the outside major axis and about 22.5 mm on the outside minor axis.

17. The kit of claim 14, wherein the rod is made of 304 or 304L stainless steel tubing.

18. The kit of claim 14, the bracket further comprising a pair of bulkheads secured parallel to each other within the bracket and perpendicular to the longitudinal axis of the bracket spaced at a distance greater than the length of the swivel vertical member, thereby strengthening the bracket, guiding the swivel, and supporting the swivel and rod when assembled.

19. The kit of claim 14, the bracket further comprising a hole outside the cutout adapted to receive a mounting screw.

20. The kit of claim 14, wherein the bracket and swivel are made of one selected from the group consisting of aluminum alloy, zinc, and brass.

* * * * *